US009481514B2

(12) United States Patent
O'Brien

(10) Patent No.: US 9,481,514 B2
(45) Date of Patent: Nov. 1, 2016

(54) TRASH BAG SECURING SYSTEM

(71) Applicant: Brian Boru O'Brien, Glen Gardner, NJ (US)

(72) Inventor: Brian Boru O'Brien, Glen Gardner, NJ (US)

( * ) Notice: Subject to any disclaimer, the term of this patent is extended or adjusted under 35 U.S.C. 154(b) by 0 days.

(21) Appl. No.: 14/284,649

(22) Filed: May 22, 2014

(65) Prior Publication Data

US 2014/0346176 A1 Nov. 27, 2014

Related U.S. Application Data

(60) Provisional application No. 61/826,363, filed on May 22, 2013.

(51) Int. Cl.
*B65F 1/06* (2006.01)

(52) U.S. Cl.
CPC ..... *B65F 1/06* (2013.01)

(58) Field of Classification Search
CPC ..... B65D 33/00; B65D 33/16; B65D 33/30; B65F 1/00; B65F 1/04; B65F 1/06; B65F 1/14
USPC ..... 220/495.06, 495.08, 495.11, 908, 220/908.1; 248/95, 99–101
See application file for complete search history.

(56) References Cited

U.S. PATENT DOCUMENTS 2,092,969 A * 9/1937 Gustafson et al. ..... 229/117.29
2,327,095 A * 8/1943 Cleary ..... B65D 5/643 229/117.17
2,819,008 A * 1/1958 White ..... B65D 5/4295 206/521.1
3,927,445 A * 12/1975 Pavlish ..... B65F 1/06 24/30.5 L
4,338,979 A * 7/1982 Dow ..... 141/10
5,156,328 A * 10/1992 Wozniacki ..... 229/125.22
5,217,271 A 6/1993 Moe
5,295,606 A * 3/1994 Karwoski ..... 220/4.01
D353,696 S * 12/1994 Spencer ..... D34/10
5,690,247 A * 11/1997 Boover ..... B65F 1/068 220/495.11
5,732,845 A 3/1998 Armaly
5,806,416 A * 9/1998 Cerniglia et al. ..... 100/90
6,003,717 A * 12/1999 Long ..... 220/495.11
6,056,147 A 5/2000 Jarman
6,193,095 B1 * 2/2001 McNeil ..... B65F 1/062 220/495.07
6,659,407 B2 * 12/2003 Asaro ..... 248/97
7,080,750 B2 * 7/2006 Wein et al. ..... 220/495.01
8,240,621 B1 * 8/2012 Singh ..... 248/99
2005/0017010 A1 1/2005 Siegel
2005/0150939 A1 * 7/2005 Fakes ..... B65D 5/0227 229/235
2005/0249439 A1 * 11/2005 Penson ..... 383/38
2008/0006637 A1 * 1/2008 Feeney ..... 220/495.06
2008/0179330 A1 * 7/2008 Brooks et al. ..... 220/495.08
2014/0231435 A1 * 8/2014 McCabe ..... 220/495.08

FOREIGN PATENT DOCUMENTS

JP 2002347901 A * 12/2002

* cited by examiner

*Primary Examiner* — J. Gregory Pickett
*Assistant Examiner* — Brijesh V. Patel
(74) *Attorney, Agent, or Firm* — Michael P. Kochka, Esq.

(57) ABSTRACT

A trash bag securing system having a plastic liner; the plastic liner inserted into the trash receptacle and placed over the at least one sidewall; a single elastic cord having a first end and a second end and which culminates in at least one knot. The at least one knot anchors the elastic cord to the receptacle. The at least one knot is a stopper at either the first end or the second end of the elastic cord and positioned on the outer surface of the least one sidewall. The elastic cord is inserted into the at least one opening and sized and positioned to fit around the outer rim of the outer surface of the at least one sidewall and over the plastic liner such to secure the plastic liner to the receptacle. The elastic cord may also be further configured to act as a handle.

7 Claims, 12 Drawing Sheets

TRASH BAG SECURING SYSTEM

CROSS-REFERENCE TO RELATED APPLICATION

This application claims the benefit of priority of U.S. provisional application No. 61/826,363, filed May 22, 2013, the contents of which are herein incorporated by reference.

BACKGROUND OF THE INVENTION

The present invention relates to a trash bag securing system and, more particularly, to an elastic cord attached to a trash receptacle.

Typically, trash bags are not securely fastened to trash receptacles. In most cases, the bag is merely folded over the top rim of the receptacle. Often when the bag is empty and when a heavy piece of trash is thrown into the bag, the weight of the item overwhelms the trash bag causing it to collapse on itself and fall into the bottom of the receptacle.

Currently, other devices and methods to remedy the above mentioned problem are more complex, often an expensive additive, and achieve only partial results. Other devices may include clamps, springs, loops and hooks to secure the trash bag to the rim; they may also use clamps, springs, loops, hooks and, even additional elastic cords, to anchor the primary elastic cord to the receptacle. Most do not secure the bag around 100% of the rim of the receptacle and if they do, they do so in such a way that does not allow for adjustments that can create customized tension around the rim of the receptacle. Furthermore, the weight, bulk, and cost to manufacture these existing items make them impractical for use in a home or office.

As can be seen, there is a need for an improved trash bag securing system, especially for the home and office.

SUMMARY OF THE INVENTION

In one aspect of the present invention, a trash bag securing system comprises: a trash receptacle comprising at least one sidewall comprising an outer surface and an inner surface, wherein a receptacle is formed within the inner surface, wherein the at least one sidewall comprises a rim forming an entrance leading into the receptacle, wherein at least one opening is formed through the sidewall; an elastic cord is attached to the trash receptacle through the at least one opening, wherein the elastic cord is sized to fit around the outer surface of the sidewall.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a kitchen trash receptacle that securely holds trash bags. The present invention securely holds the trash bag open along the entire rim of the trash receptacle, while at the same time, efficiently anchoring the holding device, such as a bungee cord, to the receptacle so the holding device is not lost or misplaced. Further, the present invention does not dramatically increase the bulk, cost, or complexity of the kitchen receptacle.

The present invention may be used with existing drawer style kitchen trash receptacles. By combining the existing design of a generic trash receptacle with a system of holes, knots and lacing patterns for the elastic band, the present invention provides an ideal and novel method for holding trash bags around the rim of any trash receptacle, including bottomless trash receptacles.

Figure 1:
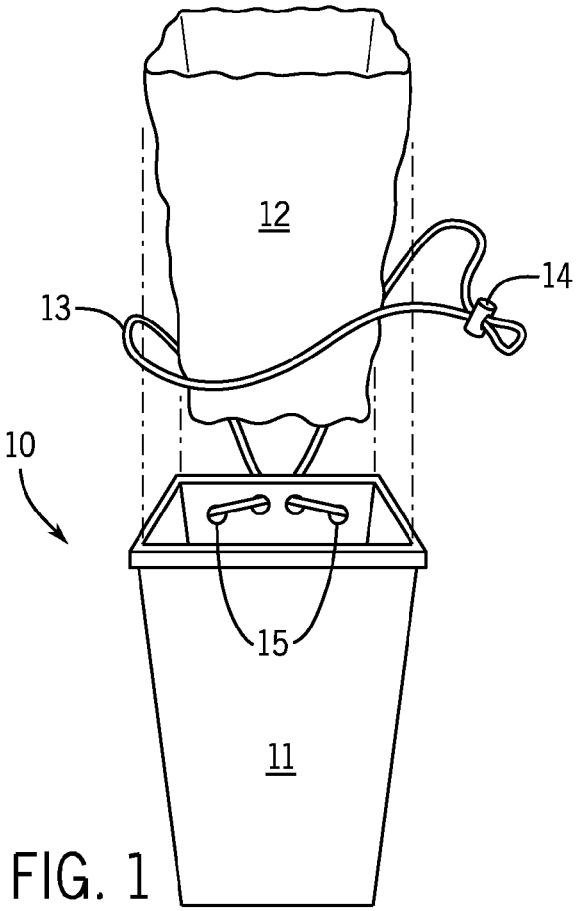
FIG. 1 is a front exploded perspective view of the first embodiment of the present invention just prior to use.
Figure 2:
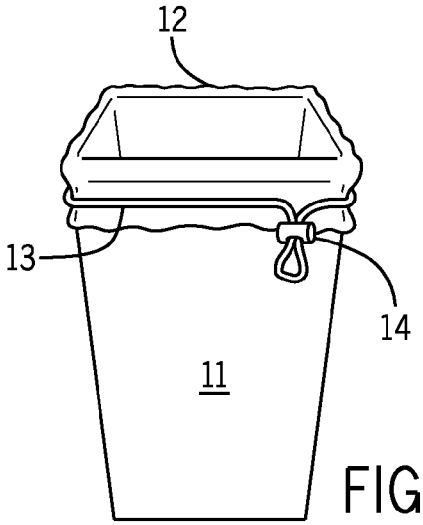
FIG. 2 is a front perspective view of the first embodiment of the present invention in use.
Figure 3:
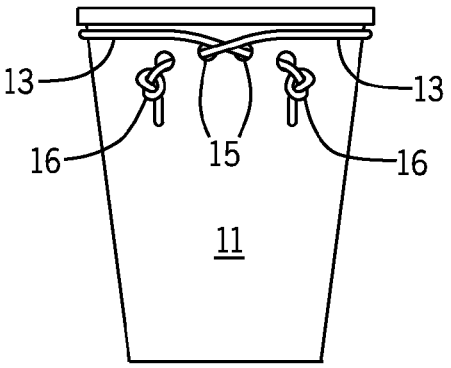
FIG. 3 is a rear elevation view of the first embodiment of the present invention without the trash bag showing the arrangement of the elastic cord.
Figure 4:
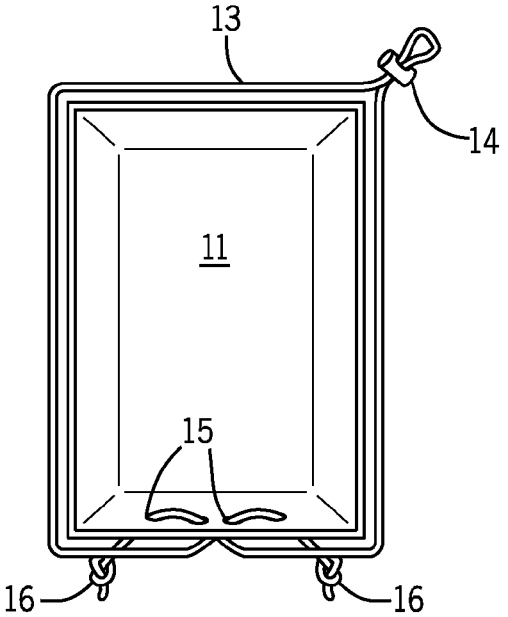
FIG. 4 is a top plan view of the first embodiment of the present invention without the trash bag showing the arrangement of the elastic cord.
Figure 5:
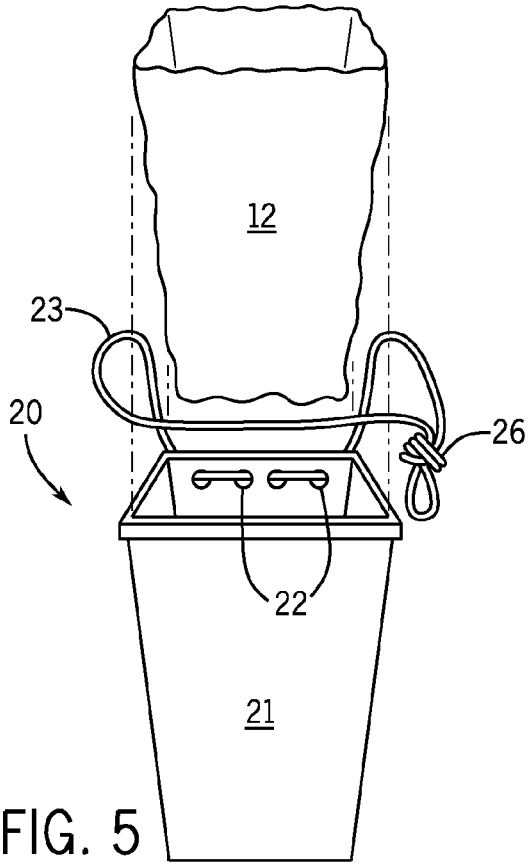
FIG. 5 is a front exploded perspective view of the second embodiment of the present invention just prior to use.
Figure 6:
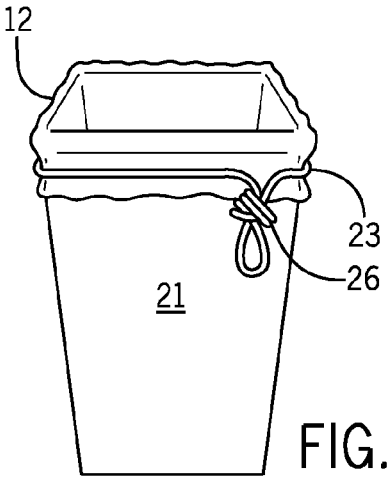
FIG. 6 is a front perspective view of the second embodiment of the present invention in use.
Figure 7:
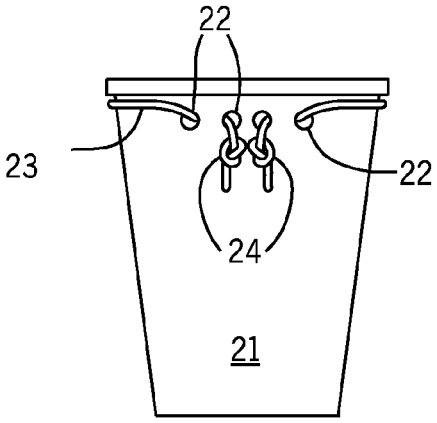
FIG. 7 is a rear elevation view of the second embodiment of the present invention without the trash bag showing the arrangement of the elastic cord.
Figure 8:
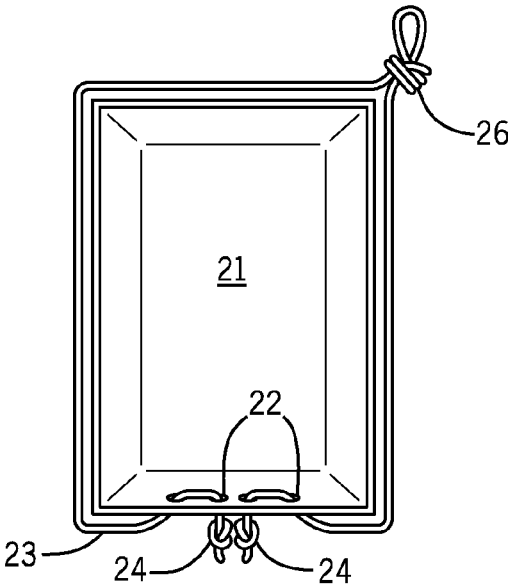
FIG. 8 is a top plan view of the second embodiment of the present invention without the trash bag showing the arrangement of the elastic cord.
Figure 9:
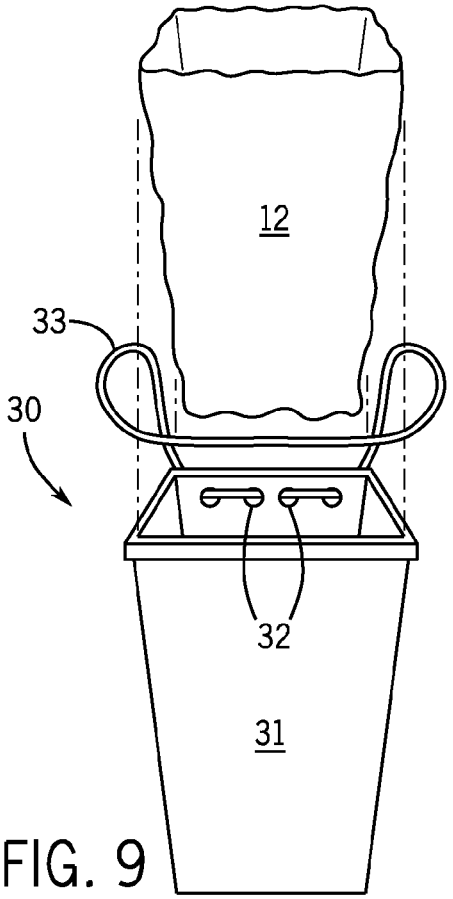
FIG. 9 is a front exploded perspective view of the third embodiment of the present invention just prior to use.
Figure 10:
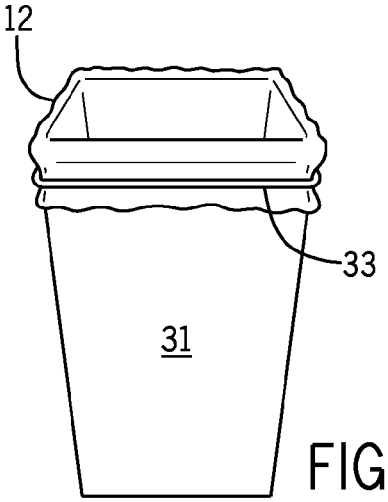
FIG. 10 is a front perspective view of the third embodiment of the present invention in use.
Figure 11:
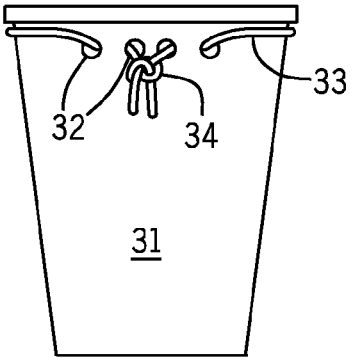
FIG. 11 is a rear elevation view of the third embodiment of the present invention without the trash bag showing the arrangement of the elastic cord.
Figure 12:
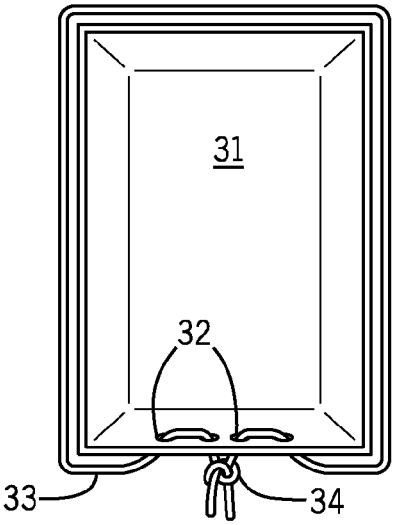
FIG. 12 is a top plan view of the third embodiment of the present invention without the trash bag showing the arrangement of the elastic cord.
Figure 13:
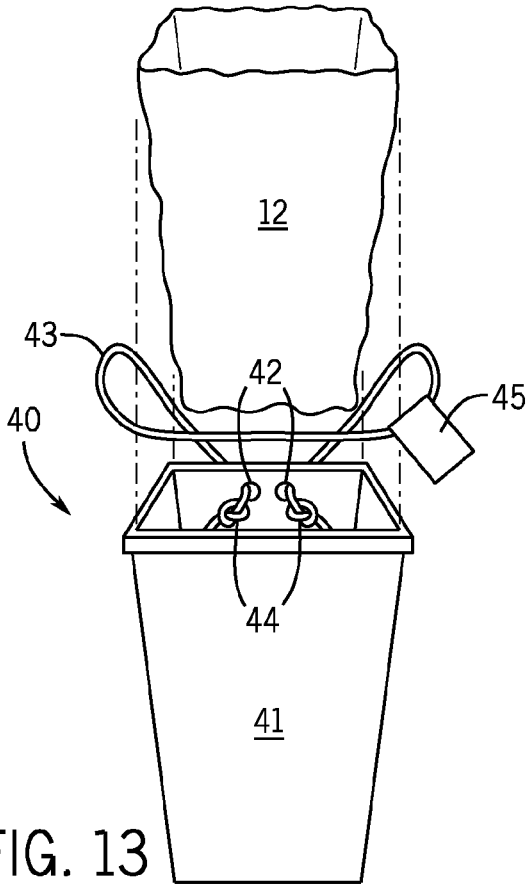
FIG. 13 is a front exploded perspective view of the fourth embodiment of the present invention just prior to use.
Figure 14:
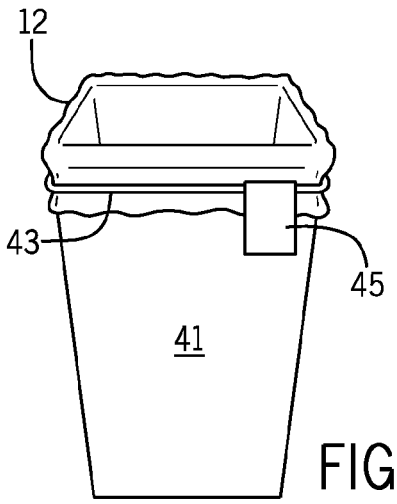
FIG. 14 is a front perspective view of the fourth embodiment of the present invention in use.
Figure 15:
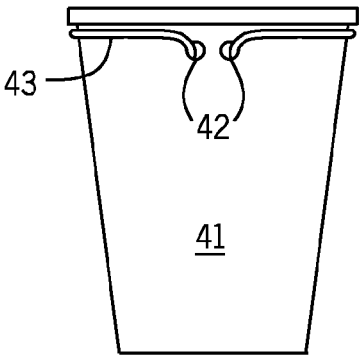
FIG. 15 is a rear elevation view of the fourth embodiment of the present invention without the trash bag showing the arrangement of the elastic cord.
Figure 16:
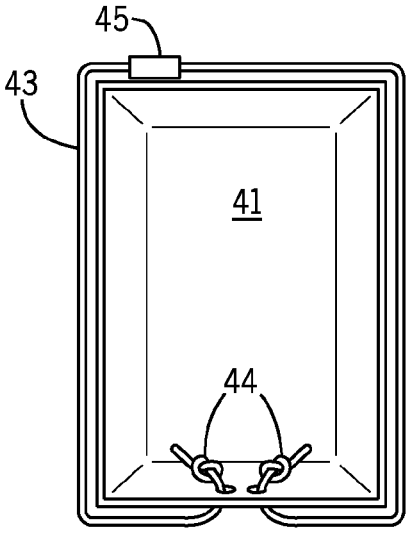
FIG. 16 is a top plan view of the fourth embodiment of the present invention without the trash bag showing the arrangement of the elastic cord.
Figure 17:
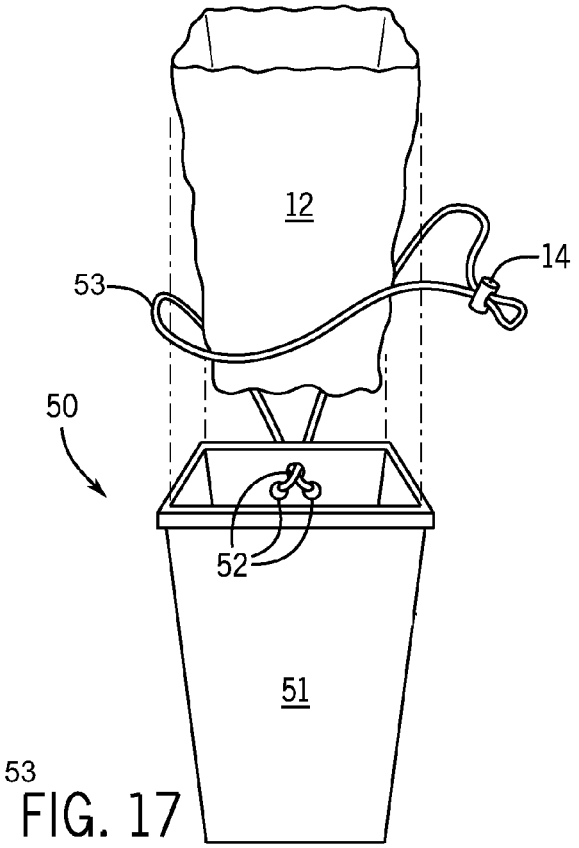
FIG. 17 is a front exploded perspective view of the fifth embodiment of the present invention just prior to use.
Figure 18:
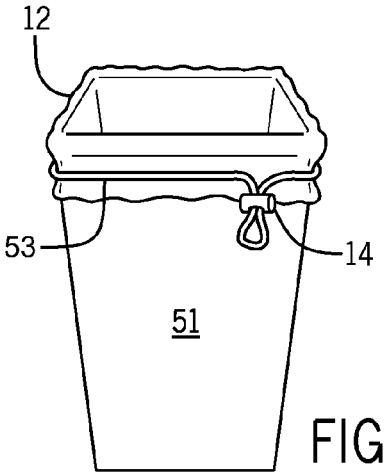
FIG. 18 is a front perspective view of the fifth embodiment of the present invention in use.
Figure 19:
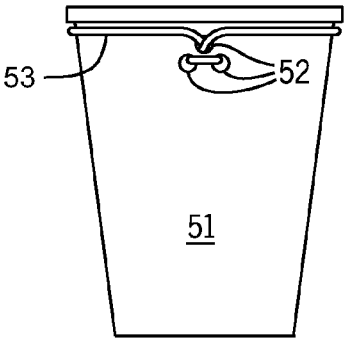
FIG. 19 is a rear elevation view of the fifth embodiment of the present invention without the trash bag showing the arrangement of the elastic cord.
Figure 20:
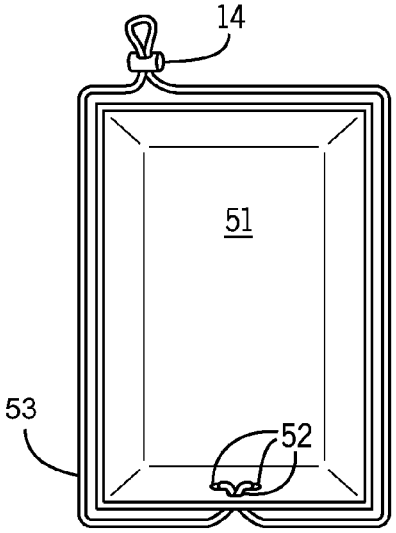
FIG. 20 is a top plan view of the fifth embodiment of the present invention without the trash bag showing the arrangement of the elastic cord.
Figure 21:
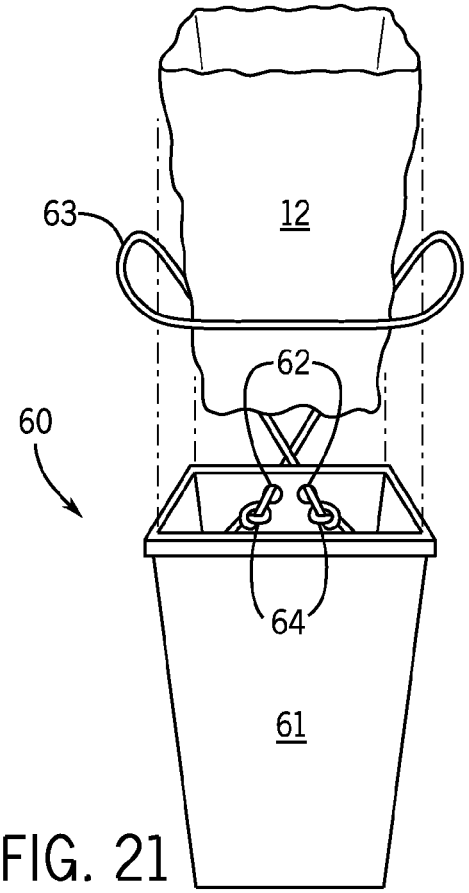
FIG. 21 is a front exploded perspective view of the sixth embodiment of the present invention just prior to use.
Figure 22:
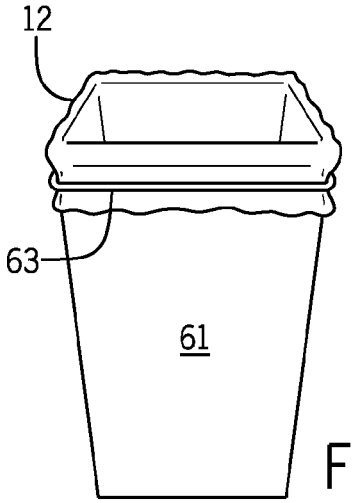
FIG. 22 is a front perspective view of the sixth embodiment of the present invention in use.
Figure 23:
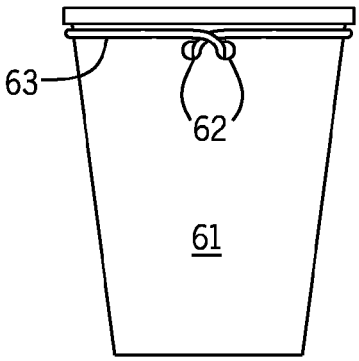
FIG. 23 is a rear elevation view of the sixth embodiment of the present invention without the trash bag showing the arrangement of the elastic cord.
Figure 24:
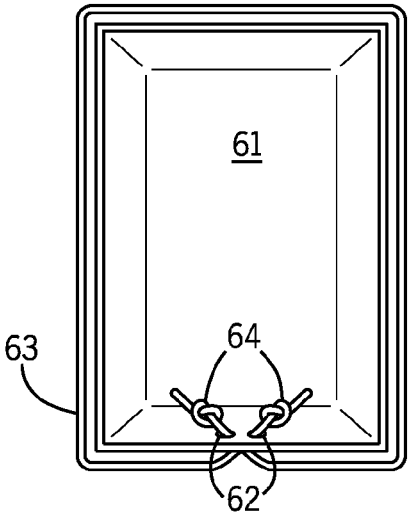
FIG. 24 is a top plan view of the sixth embodiment of the present invention without the trash bag showing the arrangement of the elastic cord.
Figure 25:
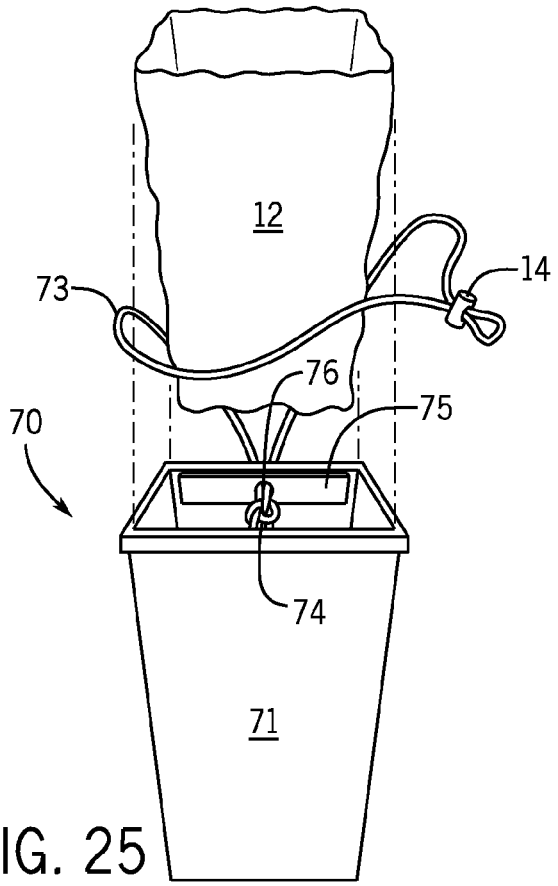
FIG. 25 is a front exploded perspective view of the seventh embodiment of the present invention just prior to use.
Figure 26:
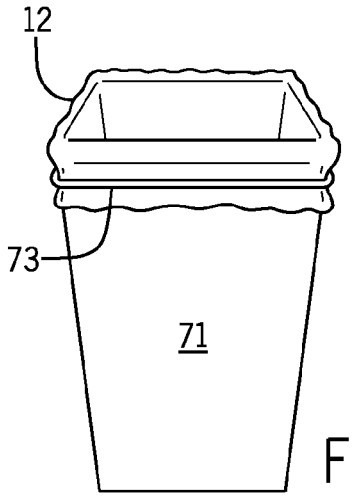
FIG. 26 is a front perspective view of the seventh embodiment of the present invention in use.
Figure 27:
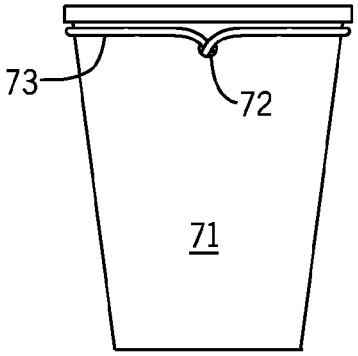
FIG. 27 is a rear elevation view of the seventh embodiment of the present invention without the trash bag showing the arrangement of the elastic cord used with a reinforcement.
Figure 28:
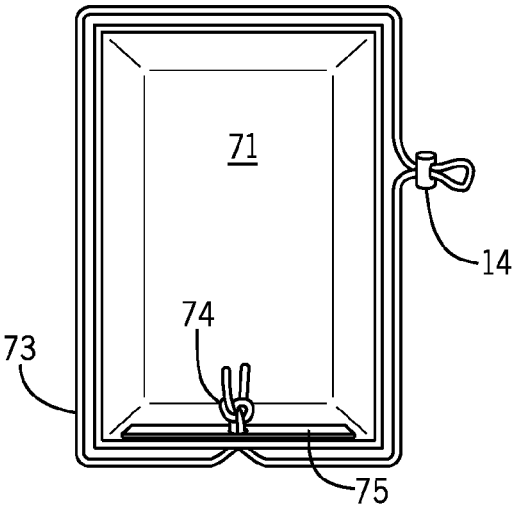
FIG. 28 is a top plan view of the seventh embodiment of the present invention without the trash bag showing the arrangement of the elastic cord used with a reinforcement.
Figure 29:
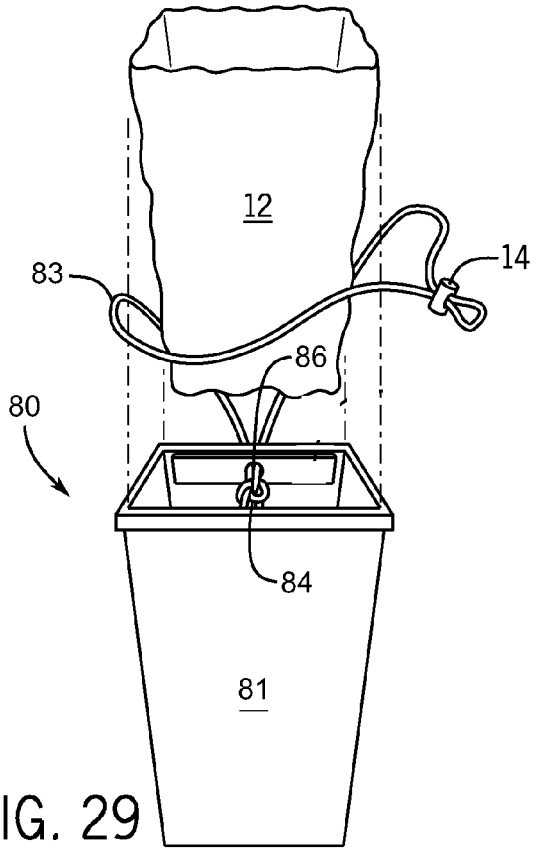
FIG. 29 is a front exploded perspective view of the eighth embodiment of the present invention just prior to use.
Figure 30:
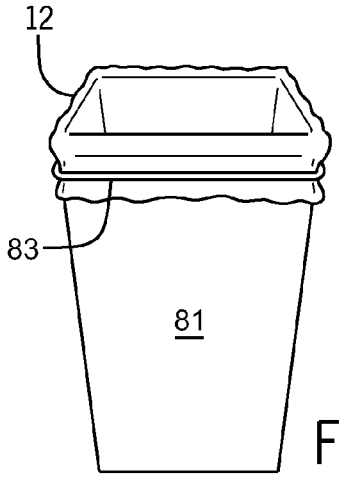
FIG. 30 is a front perspective view of the eighth embodiment of the present invention in use.
Figure 31:
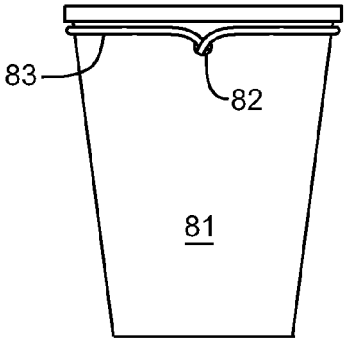
FIG. 31 is a rear elevation view of the eighth embodiment of the present invention without the trash bag showing the arrangement of the elastic cord used with a reinforcement.
Figure 32:
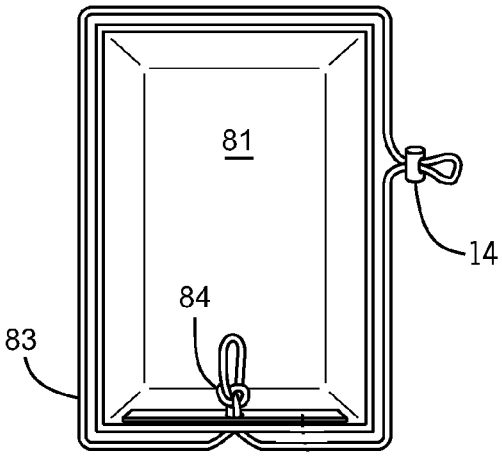
FIG. 32 is a top plan view of the eighth embodiment of the present invention without the trash bag showing the arrangement of the elastic cord used with a reinforcement.
Figure 33:
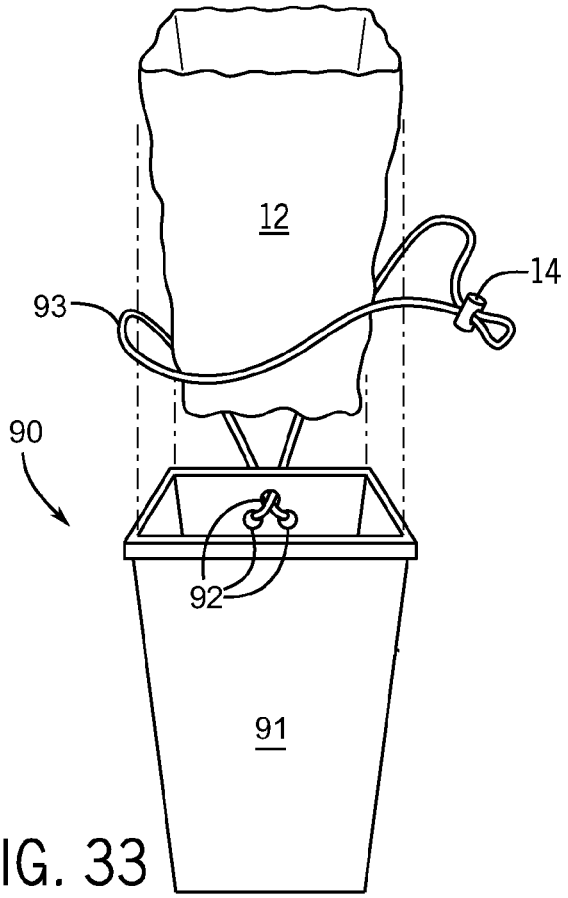
FIG. 33 is a front exploded perspective view of the ninth embodiment of the present invention just prior to use.
Figure 34:
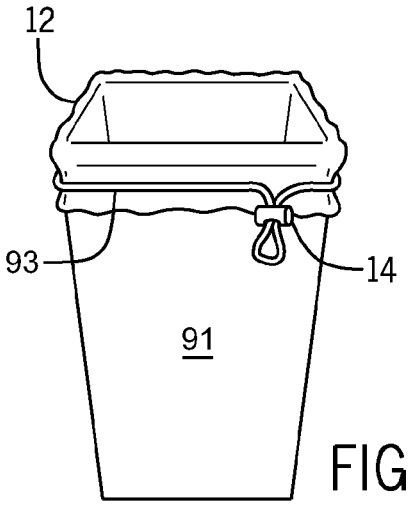
FIG. 34 is a front perspective view of the ninth embodiment of the present invention in use.
Figure 35:
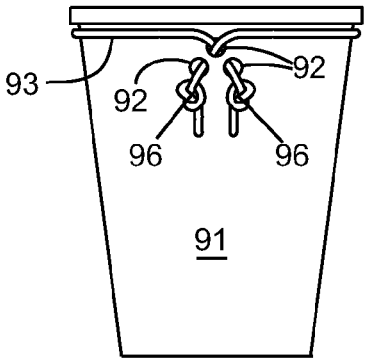
FIG. 35 is a rear elevation view of the ninth embodiment of the present invention without the trash bag showing the arrangement of the elastic cord.
Figure 36:
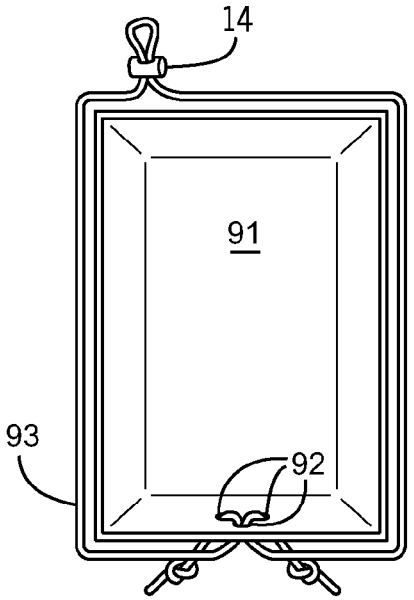
FIG. 36 is a top plan view of the ninth embodiment of the present invention without the trash bag showing the arrangement of the elastic cord.
Figure 37:
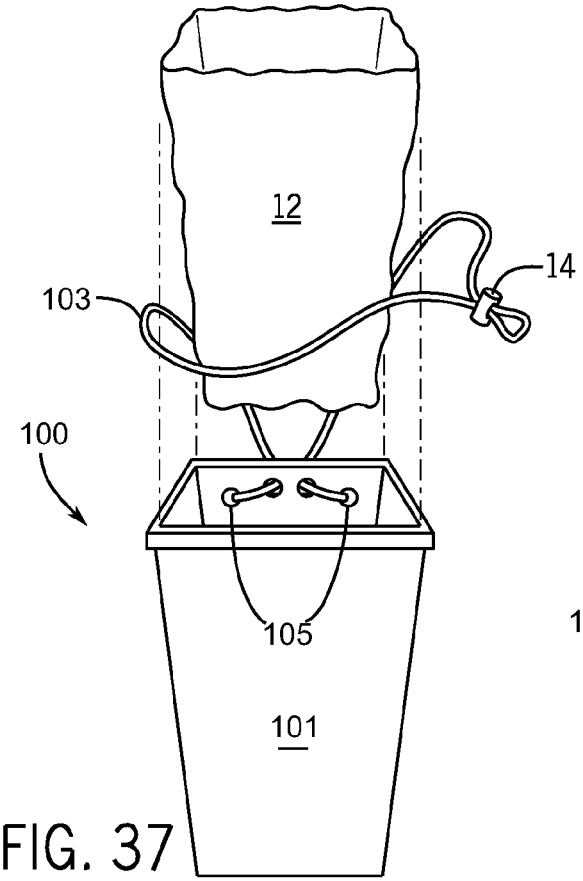
FIG. 37 is a front exploded perspective view of the tenth embodiment of the present invention just prior to use.
Figure 38:
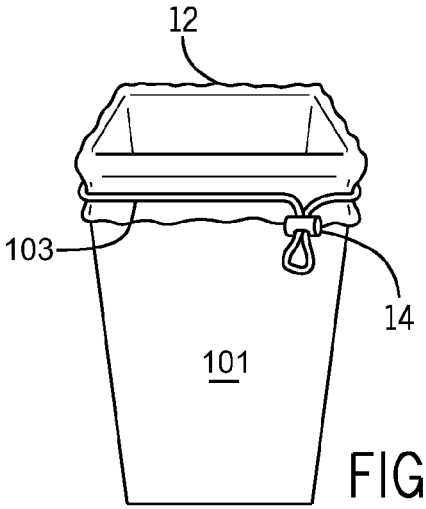
FIG. 38 is a front perspective view of the tenth embodiment of the present invention in use.
Figure 39:
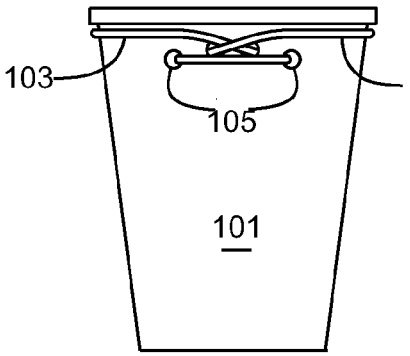
FIG. 39 is a rear elevation view of the tenth embodiment of the present invention without the trash bag showing the arrangement of the elastic cord.
Figure 40:
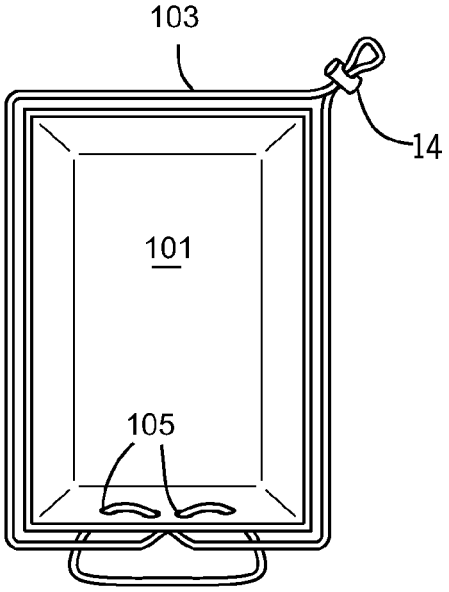
FIG. 40 is a top plan view of the tenth embodiment of the present invention without the trash bag showing the arrangement of the elastic cord.
Figure 41:
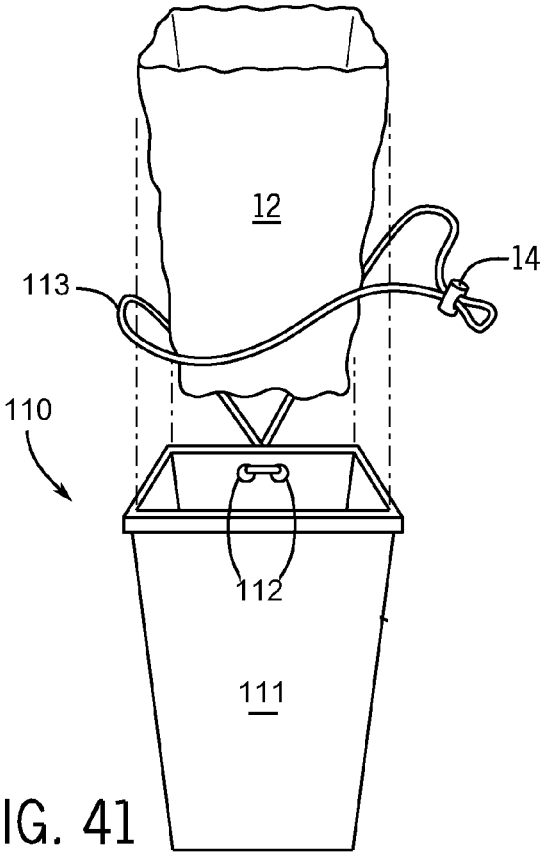
FIG. 41 is a front exploded perspective view of the eleventh embodiment of the present invention just prior to use.
Figure 42:
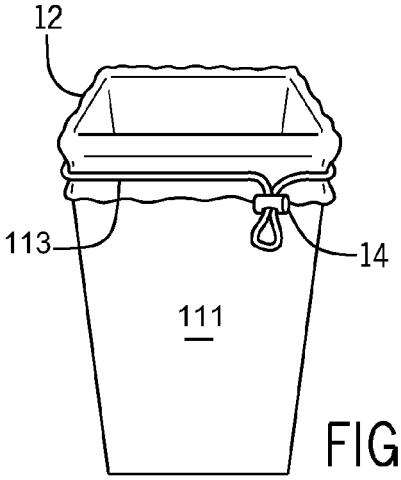
FIG. 42 is a front perspective view of the eleventh embodiment of the present invention in use.
Figure 43:
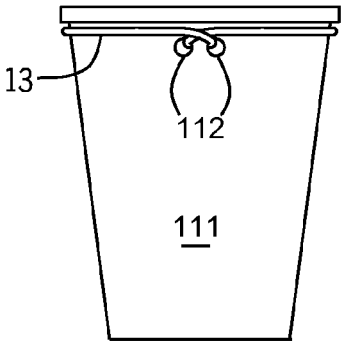
FIG. 43 is a rear elevation view of the eleventh embodiment of the present invention without the trash bag showing the arrangement of the elastic cord.
Figure 44:
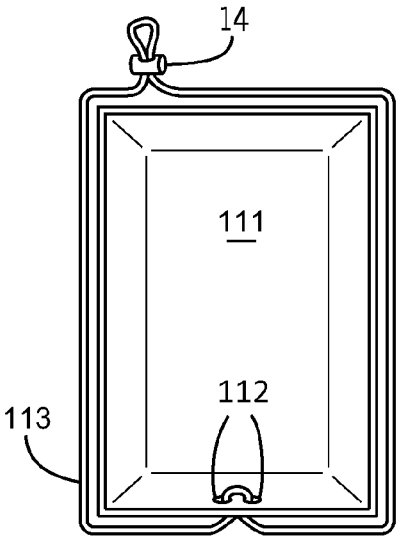
FIG. 44 is a top plan view of the eleventh embodiment of the present invention without the trash bag showing the arrangement of the elastic cord.
Figure 45:
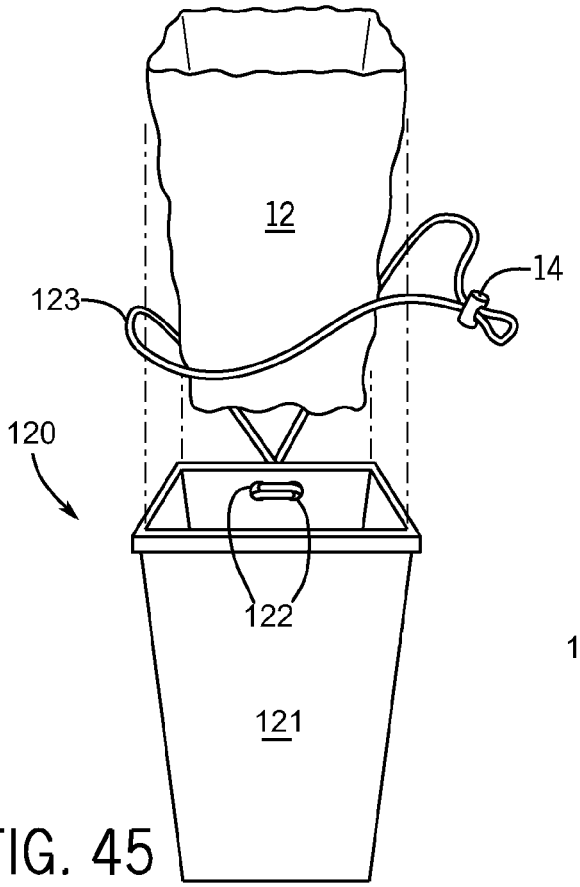
FIG. 45 is a front exploded perspective view of the twelfth embodiment of the present invention just prior to use.
Figure 46:
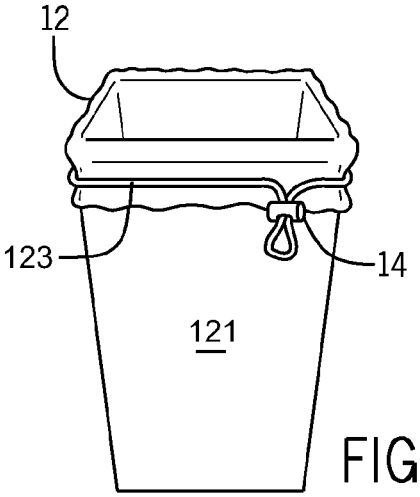
FIG. 46 is a front perspective view of the twelfth embodiment of the present invention in use.
Figure 47:
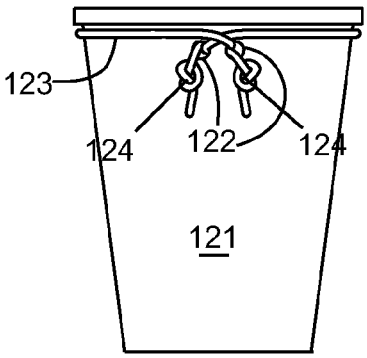
FIG. 47 is a rear elevation view of the twelfth embodiment of the present invention without the trash bag showing the arrangement of the elastic cord.
Figure 48:
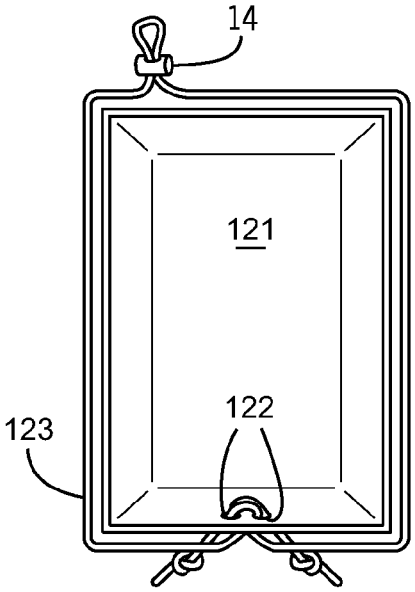
FIG. 48 is a top plan view of the twelfth embodiment of the present invention without the trash bag showing the arrangement of the elastic cord.

Referring to FIGS. 1 through 48, the present invention includes a trash bag securing device 10. The trash bag securing device 10 includes a rigid trash receptacle 11. The trash receptacle 11 includes a bottom portion and at least one sidewall extending from the bottom portion. The sidewall includes an inner surface and an outer surface, with the receptacle formed within the inner surface of the sidewall. The sidewall further includes a rim forming an entrance leading into the receptacle. At least one opening 15 is formed through the sidewall. The trash bag securing device 10 may further include an elastic cord 13, such as a stretchable bungee cord 13. The elastic cord 13 is attached to the trash receptacle through the at least one opening 15. The elastic cord 13 is sized to fit snuggly around the outer surface of the sidewall to secure a trash bag 12 to the trash receptacle 11. In certain embodiments, the elastic cord 13 may be a continuous, unbroken loop. In certain embodiments, the elastic cord 13 may be broken with a first and second end.

In certain embodiments, a stopper is formed at ends of the elastic cord 13. The stopper may include a diameter larger than the at least one opening 15 of the trash receptacle 11. The stopper may be achieved by knotting or cinching one end of elastic cord 13 or tying the ends of the elastic cord 13 together. In certain embodiments, a smaller loop may be formed by tying a knot 26 or attaching an adjustable cord lock 14 to a portion of the elastic cord 13. The cord lock 14 may be used to tighten or loosen the elastic cord 13 around the trash receptacle 11. The cord lock 14 may adjust the elastic cord 13 so that the length of the cord 13 is slightly smaller than the perimeter of the rim.

In certain embodiments, a handle may be attached to the elastic cord 13. For example, a tag 45 may be attached to the elastic cord 13 so that a user may easily grasp and manipulate the elastic cord 13. In certain embodiments, the loop formed may also be used as a handle to grasp the elastic cord 13 in order to wrap the cord 13 around the rim or remove the cord 13 from the rim.

The elastic cord 13 may be stretched out and placed over the upper rim of the receptacle 11 so that it can hold itself and any generic trash bag 12 securely in place so that the generic trash bag 12 does not collapse in on itself when a heavy item is thrown into the receptacle 11 or due to heavy gusts. When the user is ready to remove the trash bag 12, the small handle loop formed by the knot 26 or cord lock 14, may be grasped and the elastic cord 13 may be pulled off of the rim of the trash receptacle 11. The elastic cord 13 may be released but remains securely connected to the trash receptacle 11. The full trash bag 12 is removed and the new bag is replaced and held securely open in place in the inside of the receptacle 11 in the same fashion as previously described.

In certain embodiments, the elastic cord 13 may be overlapped over itself so that it may be certain to provide a definitive hold on the trash bag 12 around 100% of the outer rim of the trash receptacle 11.

In certain embodiments, a reinforcement may be utilized with the present invention. The reinforcement may include a large knot, a big round button, or a flat rectangular piece of plastic with a hole in it, such as a plate 75. The plate 75 may be fastened to the trash receptacle 11. For example, the plate 75 may be attached to the inner surface of the at least one sidewall. The plate 75 may include at least one opening 76 that aligns with the at least one opening 15, 72 of the sidewall.

In embodiments as illustrated in FIGS. 1 through 4, the trash receptacle 11 may include four sidewalls. The present invention may include four openings 15, including two outer openings 15 and two inner openings 15, just below the rim of one of the sidewalls. The elastic cord 13 may include a first end and a second end. The first end may include a knot 16 resting on the outer surface of the sidewall and the elastic cord 13 may run through one of the two outer openings. The elastic cord 13 may then run through an inner opening 15 closest to the outer opening 15 comprising the knot 16 and may run along the rim of the outer surface of the sidewalls. The second end of the elastic cord may run back through the opposite inner opening 15 as the first end and through the opposite outer opening 15 as the first end, where a second knot 16 is formed, thereby securing the elastic cord 13 to the trash receptacle 11 on the outer surface of the sidewalls. The trash bag 12 may be folded over the rim of the trash receptacle 11 and secured in between the elastic cord 13 and the trash receptacle 11.

In embodiments as illustrated in FIGS. 5 through 8, the present invention may include four openings 22, including two outer openings 22 and two inner openings 22, just below the rim of one of the sidewalls. The elastic cord 23 may include a first end and a second end. The first end may include a knot 24 resting on the outer surface of the sidewall and the elastic cord 23 may run through one of the two inner openings. The elastic cord 23 may then run through an outer opening 22 closest to the inner opening 22 comprising the knot 24 and may run along the rim of the outer surface of the sidewalls. The second end of the elastic cord may run back through the opposite outer opening 22 as the first end and through the opposite inner opening 22 as the first end, where a second knot 24 is formed, thereby securing the elastic cord 23 to the trash receptacle 21 on the outer surface of the sidewalls. The trash bag 12 may be folded over the rim of the trash receptacle 21 and secured in between the elastic cord 23 and the trash receptacle 21.

In embodiments as illustrated in FIGS. 9 through 12, the present invention may include four openings 32, including two outer openings 32 and two inner openings 32, just below the rim of one of the sidewalls. The elastic cord 33 may include a first end and a second end. The first end and the second end may be tied together to form a knot 34 and may rest on the outer surface, with the elastic cord 33 running through both of the inner openings 32. The elastic cord 33 may run through a first inner opening 32 from the knot 34 and then through the outer opening 32 closest to the first inner opening 32. The elastic cord 32 may run along the rim of the outer surface of the sidewalls. The second end of the elastic cord 33 may run back through the opposite outer opening 32 as the first end and through the second inner opening 32, where the second knot 34 is formed with the first end of the elastic cord 33, thereby securing the elastic cord 33 to the trash receptacle 31 on the outer surface of the sidewalls. The trash bag 12 may be folded over the rim of the trash receptacle 31 and secured in between the elastic cord 33 and the trash receptacle 31.

In embodiments as illustrated in FIGS. 13 through 16, the present invention may include two openings 42, including a first opening 42 and a second opening 42, just below the rim of one of the sidewalls. The elastic cord 43 may include a first end and a second end. The first end may be tied in a knot 44 and may rest within the inner surface of the sidewall. The elastic cord 43 may run through the first opening and along the rim of the outer surface of the sidewalls. The second end of the elastic cord 43 may run through the second opening 42 and may be tied off at a knot 44 within the inner surface of the sidewall, thereby securing the elastic cord 43 to the trash receptacle 41 on the outer surface of the sidewalls. The trash bag 12 may be folded over the rim of the trash receptacle 41 and secured in between the elastic cord 43 and the trash receptacle 41.

In embodiments as illustrated in FIGS. 17 through 20, the present invention may include three openings 52, including a first opening 52, a second opening 52 and a third opening 52, just below the rim of one of the sidewalls. The elastic cord 53 may be continuous and unbroken. In such embodiments, the elastic cord 53 may loop through the first opening 52, the second opening 52, and the third opening 52 and wrap around the rim of the outer surface of the sidewalls. The elastic cord 53 may be anchored to receptacle 51 without the use of a stopper and stretched to fit snuggly around the outer sidewall surfaces of trash receptacle 51. The trash bag 12 may be folded over the rim of the trash receptacle 51 and may be secured in between the elastic cord 53 and the trash receptacle 51.

In embodiments as illustrated in FIGS. 21 through 24, the present invention may include two openings 62, including a first opening 62 and a second opening 62, just below the rim of one of the sidewalls. The elastic cord 63 may include a first end and a second end. The first end may be tied in a knot 64 and rest within the inner surface of the sidewall. The elastic cord 63 may run from the knot 64 through the first opening in the direction of the second opening and along the rim of the outer surface of the sidewalls. The second end of the elastic cord 63 may run through the second opening 62 and may be tied off at a knot 64 within the inner surface of the sidewall, thereby securing the elastic cord 63 to the trash receptacle 61 on the outer surface of the sidewalls. The trash bag 12 may be folded over the rim of the trash receptacle 61 and secured in between the elastic cord 63 and the trash receptacle 61.

In embodiments as illustrated in FIGS. 25 through 28, the present invention may include a single opening 72 just below the rim of one of the sidewalls. The elastic cord 73 may include a first end and a second end. The first end and second end may run through the single opening 72 and may be tied together in a knot 74 within the inner surface of the sidewall. The elastic cord 73 may run out of the opening 72 and along the rim of the outer surface of the sidewalls and back into the opening 72. The trash bag 12 may be folded over the rim of the trash receptacle 71 and secured in between the elastic cord 73 and the trash receptacle 71.

In embodiments as illustrated in FIGS. 29 through 32, the present invention may include a single opening 84 just below the rim of one of the sidewalls. The elastic cord 83 may be an unbroken and continuous elastic cord 83. A portion of the elastic cord 83 may protrude into the inner surface of the sidewall, and the portion may be tied into a knot 84. The elastic cord 83 may run out of the opening 82 and may be overlapped upon itself so that it may run along 100% of the entire rim of the outer surface of the sidewalls. The trash bag 12 may be folded over the rim of the trash receptacle 81 and secured in between the elastic cord 83 and the trash receptacle 81.

In embodiments as illustrated in FIGS. 33 through 36, the present invention may include three openings 92, including a first outer opening 92, a middle opening 92 and a second outer opening 92, just below the rim of one of the sidewalls. The elastic cord 93 may include a first end and a second end. The first end may include a knot 96 resting on the outer surface of the sidewall and the elastic cord 93 may run through the first outer opening 92. The elastic cord 93 may run from the first outer opening and out of the middle opening 92 and may run along the rim of the outer surface of the sidewalls. The second end of the elastic cord may overlap a portion of cord 93 and run back through the middle opening 92 and out of the second outer opening 92 where a second knot 96 is formed, thereby securing the elastic cord 93 to the trash receptacle 91 on the outer surface of the sidewalls. The trash bag 12 may be folded over the rim of the trash receptacle 91 and may be secured around 100% of the outer rim of receptacle 91 in between the elastic cord 93 and the trash receptacle 91.

In embodiments as illustrated in FIGS. 37 through 40, the present invention may include four openings 105, including a first outer opening 105, a first middle opening 105, a second middle opening 105 and a second outer opening 105, just below the rim of one of the sidewalls. The elastic cord 103 may be continuous and unbroken. In such embodiments, the elastic cord 103 may loop through the first outer opening 105, the first middle opening 105, the second middle opening 105 and the second outer opening 105 and wrap around the rim of the outer surface of the sidewalls, thereby simultaneously anchoring the elastic cord 103 to the trash receptacle 101 on a portion of inner and all of the outer surfaces of the sidewalls. The trash bag 12 may be folded over the rim of the trash receptacle 101 and secured in between the elastic cord 103 and the trash receptacle 101.

In embodiments as illustrated in FIGS. 41 through 44, the present invention may include two openings 112, including a first opening 112, and a second opening 112, just below the rim of one of the sidewalls. The elastic cord 113 may be continuous and unbroken. In such embodiments, the elastic cord 113 may loop through the first opening 112 and the second opening 112, cross over one another and wrap around the rim of the outer surface of the sidewalls, thereby securing the elastic cord 113 to the trash receptacle 111 on the outer surface of the sidewalls. The trash bag 12 may be folded over the rim of the trash receptacle 121 and secured in between the elastic cord 123 and the trash receptacle 121.

In embodiments as illustrated in FIGS. 45 through 48, the present invention may include two openings 122, including a first opening 122 and a second opening 122, just below the rim of one of the sidewalls. The elastic cord 123 may include a first end and a second end. The first end may be tied in a knot 124 and rest on the outer surface of the sidewall. The elastic cord 123 may run from the knot 124 through the first opening and then through the second opening. From the second opening 122, the cord 123 may run back towards the first opening 122 and along the rim of the outer surface of the sidewalls. The second end of the elastic cord 123 may run through the first opening 122 and back through the second opening 122. The second end may be tied off at a knot 124 on the outside surface of the sidewall, thereby securing the elastic cord 123 to the trash receptacle 121 on the outer surface of the sidewalls. The trash bag 12 may be folded over the rim of the trash receptacle 121 and secured in between the elastic cord 123 and the trash receptacle 121.

A method of using the present invention may include the following. A user may start by pulling the bungee cord up and off of the outer rim of the trash receptacle. The next step is to slowly release the tension on the cord and set it aside on the outside of the back panel of the receptacle. At this point, one may open an empty trash bag and place it inside the receptacle folding the top 1-2" of the bag over the top and outside rim of the receptacle. One may then grab the bungee cord, cross over itself at back (near anchor point on back panel) and place it over the plastic bag and just under the top rim of receptacle. The bungee may rest snuggly against both the plastic bag and the receptacle encircling up to 100% of the rim while holding the bag open and secure. When the bag is full, one may pull the loop handle away and up over the top of the receptacle. One may slowly release and gently remove the unanchored portion of the bungee cord away from rim. Finally, one may remove and discard the full trash bag and replace it with new empty garbage bag as described previously.

Additionally, the present invention may be useful for the collection of industrial and medical waste and/or incorporation with trash receptacles other than those described in detail above such as receptacles with attached or detached lids, or those with foot-pedal powered "flip-lids" and the like. The present invention may also be used in the storage of food or other items wherein the bungee cord incorporates a plastic or cloth sheet sewn to its stretched top and in the exact shape of the receptacle container (be it round, square, rectangular or whatever) thus making a virtually air tight container but without use of a hard top.

It should be understood, of course, that the foregoing relates to exemplary embodiments of the invention and that modifications may be made without departing from the spirit and scope of the invention as set forth in the following claims.

What is claimed is:

1. A trash bag securing system comprising:

a trash receptacle comprising at least one sidewall comprising an outer surface and an inner surface, wherein a receptacle is formed within the inner surface, wherein the at least one sidewall comprises an outer rim forming an entrance leading into the receptacle, and wherein three openings are formed through a single sidewall of the at least one sidewall in a triangular configuration, the three openings comprising a first lower opening and a second lower opening positioned at the same height on the at least one sidewall and an upper opening having a top edge positioned above the first and second lower openings and closer to the outer rim;

an elastic cord attached to the trash receptacle through the three openings, the elastic cord having a first end having a first knot, a second end having a second knot, and a center portion disposed between the first end and the second end, the first knot and the second knot anchoring the elastic cord to the receptacle, the first knot positioned on an exterior portion of the first lower opening and the second knot positioned on an exterior portion of the second lower opening, wherein the center portion of the elastic cord extends from an interior portion of the receptacle through the upper opening to an exterior portion of the upper opening; and wherein the elastic cord is sized and positioned to fit around the outer rim and over a plastic liner such to secure and circumnavigate the plastic liner to the outer rim.

2. The trash bag securing system of claim 1, wherein the elastic cord runs through the three openings and around the outer surface of the at least one sidewall.

3. The trash bag securing system of claim 1, wherein a cord lock is attached to a portion of the elastic cord.

4. The trash bag securing system of claim 1, wherein the center portion of the elastic cord is tied into a knot forming a loop.

5. The trash bag securing system of claim 1, wherein the elastic cord is comprised of broken segments.

6. The trash bag securing system of claim 1, wherein the elastic cord overlaps itself around the outer surface of the at least one sidewall.

7. A trash bag securing system comprising:

a trash receptacle comprising at least one sidewall comprising an outer surface and an inner surface, wherein a receptacle is formed within the inner surface, wherein the at least one sidewall comprises an outer rim forming an entrance leading into the receptacle, and wherein three openings are formed through a single sidewall of the at least one sidewall in a triangular configuration, the three openings comprising a first lower opening and a second lower opening positioned at the same height on the at least one sidewall and an upper opening having a top edge positioned above the first and second lower openings and closer to the outer rim;

an elastic cord attached to the trash receptacle through the three openings, the elastic cord having a first end having a first stopper, a second end having a second stopper, and a center portion disposed between the first end and the second end, the first stopper and the second stopper anchoring the elastic cord to the receptacle, the first stopper positioned on an exterior portion of the first lower opening and the second stopper positioned on an exterior portion of the second lower opening, wherein the center portion of the elastic cord extends from an interior portion of the receptacle through the upper opening to an exterior portion of the upper opening; and wherein the elastic cord is sized and positioned to fit around the outer rim and over a plastic liner such to secure and circumnavigate the plastic liner to the outer rim.

* * * * *